United States Patent [19]

Fidi et al.

[11] Patent Number: 4,858,719

[45] Date of Patent: Aug. 22, 1989

[54] PRESSURE GRADIENT PICKUP

[75] Inventors: Werner Fidi, Baden; Heinz Renner, Kaltenleutgeben, both of Austria

[73] Assignee: AKG Akustische u. Kino-Gerate Gesellschaft m.b.H., Vienna, Austria

[21] Appl. No.: 2,870

[22] Filed: Jan. 13, 1987

[30] Foreign Application Priority Data

Jan. 16, 1986 [AT] Austria ..... 89/86
Apr. 17, 1986 [AT] Austria ..... 1015/86

[51] Int. Cl.[4] ..... G10K 13/00

[52] U.S. Cl. ..... 181/158; 181/160; 181/171; 381/153; 381/158; 381/159; 381/174; 381/177; 381/187; 381/193

[58] Field of Search ..... 181/157, 158, 160, 171; 381/91, 153, 154, 158, 159, 174, 177, 187, 188, 71, 168, 169, 178, 179, 191, 193, 202

[56] References Cited

U.S. PATENT DOCUMENTS

| | | | |
|---|---|---|---|
| 1,964,606 | 6/1934 | Thures | 381/158 |
| 2,529,467 | 11/1950 | Wiggins | 181/158 X |
| 2,627,558 | 2/1953 | Wiggins | 181/158 X |
| 2,699,473 | 1/1955 | Kettler et al. | 181/158 X |
| 3,418,437 | 12/1968 | Hoffmann | 381/177 X |
| 4,239,945 | 12/1980 | Atoji et al. | 381/187 X |
| 4,258,235 | 3/1981 | Watson | 381/191 |
| 4,581,496 | 4/1986 | Sweeny | 381/158 |

FOREIGN PATENT DOCUMENTS

| | | |
|---|---|---|
| 388069 | 2/1933 | United Kingdom . |
| 1173623 | 12/1969 | United Kingdom . |
| 1369377 | 10/1974 | United Kingdom . |
| 1499693 | 2/1978 | United Kingdom . |
| 2134745 | 8/1984 | United Kingdom . |

*Primary Examiner*—B. R. Fuller
*Attorney, Agent, or Firm*—Toren, McGeady & Associates

[57] ABSTRACT

A pressure gradient pickup, particularly a capacitor microphone or a dynamic microphone, has a diaphragm arranged in a housing and at least one sound entry opening which conducts the sound to the rear side of the diaphragm. Acoustically acting phase-shifting sections are connected in the interior of the housing to the at least one sound entry opening. The at least one sound entry opening is located at least approximately in the same plane as the diaphragm and is preferably arranged concentrically relative to the diaphragm edge.

11 Claims, 6 Drawing Sheets

PRESSURE GRADIENT PICKUP

BACKGROUND OF THE INVENTION

1. Field of the Invention

The present invention relates generally to pressure gradient pickups or gradient microphones. The invention relates particularly to a capacitor microphone or a dynamic microphone having a diaphragm mounted within a housing and at least one sound entry opening provided in the housing for conducting the sound to the rear side of the diaphragm. Accoustically acting, phase-shifting sections are connected to the sound entry opening in the interior of the housing.

2. Description of the Prior Art

Many types of pressure gradient pickups are known, primarily those having eight-shaped, cardioid, hypercardioid or supercardioid pickup patterns. The mode of operation of such sound pickups and possible embodiments thereof are known in principle from Austrian Pat. No. 248,513 which describes a moving coil microphone having a unilateral pickup effect, and from the two publications by Herbert Grosskopf entitled "Gerichtete Mikrophone mit phasendrehenden Gliedern" (Directional Microphone Having Phase-shifting Sections), FTZ, year 150, Volume 7, 1950, pages 248 to 253, and "Uber Methoden zur Erzielung eines gerichteten Schallempfangs" (Concerning Methods for Obtaining a Directed Sound Reception), Technishe Hausmitteilungen des Nordwesdeutschen Rundfunks (Technical In-house Information of the North-West German Radio), year 4, No. 11/12, 1952, pages 209 to 218.

All the pressure gradient pickups described in the above-mentioned prior art documents and in later documents have at least one sound entry provided in the transducer housing in the form of one or more openings, so that the sound can be conducted to the rear side of the diaphragm, wherein the sound entry is located in a plane which extends parallel to the plane of the diaphragm and is offset toward the transducer end.

The known pressure gradient pickups cannot be mounted in closed housings because such housings would render the one or more sound entry openings ineffective.

It is, therefore, the primary object of the present invention to generate the sound pressure difference formed by the differences in propagation time in front of and behind the diaphragm of the present gradient pickup in such a way that it is possible to mount the pickup in a closed housing and the excellent directional effect of the sound pickup is preserved.

SUMMARY OF THE INVENTION

In accordance with the present invention, the one or more sound entry openings required for the pressure gradient to become effective are provided at least approximately in the plane of the diaphragm.

In accordance with a preferred embodiment of the invention, the sound entry openings are arranged concentrically relative to the diaphragm edge.

Thus, the microphone in accordance with the present invention is closed toward the rear and the side. Consequently, the microphone can be mounted without difficulty. In addition, an especially good directional effect is obtained. A substantial sound pressure difference exists between the center of a diaphragm which is put into motion by a sound pressure field and the edge of the diaphragm which serves to mount the diaphragm and does not participate in the motion of the diaphragm. In addition, a propagation time difference exists between the wave fronts incident along the diaphragm surface of the sound pressure waves originating from the sound field. Since, to an unimpededly propagating sound wave, the housing of the pressure gradient pickup constitutes a disturbing body for the sound field, the deflection of the sound waves at the body edges and the pressure changes in the vicinity of a body introduced into the sound field facilitate the formation of a sound pressure difference between the center of the diaphragm and its edge. The sound entry opening arranged approximately in the plane of the diaphragm and preferably concentrically relative to the diaphragm edge makes it possible to have the sound pressure difference in the sound field in front of the diaphragm become effective as a pressure gradient for the pressure gradient pickup having a certain pickup pattern. This sound pressure difference which, in turn, as the pressure gradient of a sound field is dependent upon the sound incidence direction, makes it possible to realize a pressure gradient pickup having a certain directional pickup pattern. The desired result with respect to the directional effect is obtained because the dimensions of the acoustic frictions and reactances accommodated in the area of the transducer and constructed as a phase-shifting section depends to a large extent upon the sound pressure difference incident at the outside on the transducer diaphragm.

Compared to the pressure gradient pickups known in the prior art, the pickup according to the present invention has several advantages. Since the sound entry openings are arranged in the plane of the diaphragm, the pressure gradient pickup according to the invention can be easily mounted in a housing because there is no second sound entry plane which is always behind the diaphragm. Thus, the pressure gradient pickup according to the invention can be mounted in a flat structure having a large surface area size, so that the problem of realizing an interface-type microphone, also called PZM-microphone, having a directional pickup pattern is solved. The dimensions of the acoustic frictions and reactances accommodated in the interior of the transducer and constructed as phase-shifting sections depends to a large extent on the sound pressure distribution near the diaphragm surface occurring outside of the pressure gradient pickup as a result of the shape of the housing of the pickup.

Another advantage which should not be overlooked resides in the fact that the transducer according to the invention can be easily inserted or mounted in a housing which is closed toward the rear and only as openings which face toward the front, such as, a telephone hand set, while the characteristic directional pickup pattern of the transducer is maintained.

In accordance with an advantageous embodiment of the invention, the sound entry opening located at least approximately in the diaphragm plane is formed as an annular slot immediately adjacent the diaphragm edge. The provision of an annular slot means that, apart from a few support members, the sound can enter along the entire circumference of the diaphragm bottom, so that the effect with respect to the pressure difference formation and the influence on the directional pickup pattern are particularly emphasized.

In accordance with another embodiment of the invention, the sound entry opening arranged at least approximately in the diaphragm plane is provided in the form of annular segments located around the diaphragm edge. In this case, a sound incidence of similar qualities is obtained, however, the support elements are made in one piece with the microphone housing and do not constitute separate elements, so that the microphone is of simple construction without substantially impairing the directional effect.

In accordance with the another embodiment of the invention, the sound entry opening located at least approximately in the diaphragm plane is formed by a plurality of circular openings provided at the diaphragm edge. This construction results in relatively small openings. Such small openings constitute an increased acoustic mass. This effect can be further increased if bore holes are placed adjacent the circular openings. Such increased acoustic masses are desirable always in those cases in which the phase-shifting section is a L,R-section.

In the pressure gradient pickups according to the invention described above, the sound entry openings are arranged rotationally symmetrical. Thus, the directional pickup pattern is also rotationally symmetrical and oriented in the direction of the longitudinal axis of the transducer. Such a pattern is generally sufficient.

However, in some cases it may be desirable that the axis of symmetry of the directional pickup pattern does not coincide with the principal axis of the transducer, and in other cases a pickup pattern may be desirable which is not rotationally symmetrical. Microphones of this type may be useful, for example, in stereo transmissions in which the XY-system is used, during speeches in which the speaker uses a personal microphone, during conferences or live reports, or in the case of stage recordings and particularly in those cases where a directional pickup pattern is required which has an extension in one plane which is greater than the extension in the plane extending perpendicularly thereto.

In order to further develop a pressure gradient pickup in which at least two sound entry openings are provided in such a way that directional pickup patterns can be realized in which either the axis of symmetry of the directional pickup pattern does not coincide with the principal axis of the sound pickup, or in which the directional pickup pattern has a shape and size which deviates from the conventional rotationally symmetrical shape, the invention provides that the sound entry openings are arranged individually and spaced apart from one another, wherein at least one of the openings, or, if desired, some of the openings, have an acoustic damping which is greater than that of the other openings. The opening may either itself have a perceptible acoustic frictional resistance or may be provided with such a resistance. In this pickup according to the invention, it is still possible to provide a symmetrical arrangement, while the desired properties are determined with the aid of appropriately selected damping. The cross-section of the pickup lobe as well as the orientation thereof are determined by the selected damping.

The different acoustic damping of the discretely arranged openings for sound entry facilitate the obtaining of the desired pickup pattern of the pressure gradient pickup. The number, shape, size and arrangement of the individual openings together with the different damping of the openings substantially influences the specific formation of the desired directional pickup pattern. For example, a deviation of the directional pickup pattern from the rotational symmetry can be obtained by damping a pair of diametrically oppositely located openings to the same extent, while the remaining oppositely located openings are provided with different damping values. Finally a pickup pattern which is inclined relative to the principal axis of the sound pickup can be obtained by very strongly acoustically damping all the openings with the exception of a single opening.

Due to the possibility that the number of sound entry openings can be varied and the individual openings can be damped differently from each other, the pressure gradient pickup according to the invention can be easily adjusted to the structural requirements made by the microphone housing.

In accordance with the present invention, the pressure gradient pickup can also be constructed in such a way that at least two sound entry openings, preferably located opposite each other, and at most eight sound entry openings of any given shape and size are provided at the corners of polygons enclosing the transducer diaphragm. Generally, four to six openings will be sufficient for obtaining the desired effect because, due to the small sizes of modern microphones, the distances between the individual openings would become too small, so that it would no longer be possible to obtain directional pickup patterns which deviate from the rotationally symmetrical shape or whose axis of symmetry is inclined relative to the principal axis of the sound pickup. The openings can be chosen in any desired number and shape.

In a particularly useful embodiment of the invention, the pickup has four sound entry openings, wherein always two openings are located opposite each other and have a common axis of symmetry and the two axes of symmetry preferably extend perpendicularly to each other, and wherein the damping of always two oppositely located openings is equal. This is the easiest manner of obtaining a pickup pattern which is not rotationally symmetrical, wherein the pickup patterns in two perpendicularly extending sound incidence planes are different from each other in accordance with the differently selected damping. By an appropriate adjustment of the damping, it is possible, for example, to have a cardioid pickup pattern in one plane, while the pickup pattern in the perpendicularly extending plane is hypercardioid. However, depending upon the adjustment, differently formed directional pickup patterns are also possible. A pickup pattern which is not rotationally symmetrical will be of particular advantage in all those cases in which more bundling is required in one plane of sound incidence than in another plane. Thus, it is possible, for example, in microphones placed on conference tables, to better limit the sound incidence of disturbing sound generated by speaking of nearby conference participants.

In another advantageous embodiment of the present invention, two oppositely located sound entry openings are provided in which one of the openings is acoustically more damped than the other. This is the simplest manner of obtaining a pickup pattern which has an axis of symmetry which is inclined relative to the principal axis of the pressure gradient pickup. In this case, the axis of symmetry of the pickup pattern is inclined away from the principal axis toward the more strongly damped opening. Such a pickup pattern inclined relative to the principal axis of the sound pickup is of particular advantage if the sound pickup is effected by means of a personal microphone or a miniature microphone attached to an article of clothing. In addition, such a directional pickup may be advantageous during live reports when the microphone cannot be placed in the immediate vicinity of the mouth of the speaker. In order to obtain optimum pickup conditions in the just described cases of sound pickup, the axis of symmetry of the pickup pattern is directed toward the sound source, wherein the principal axis of sound pickup extends inclined relative to the pickup direction in accordance with the solid axis direction of the microphone determined by its carrier.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there are illustrated and described preferred embodiments of the invention.

BRIEF DESCRIPTION OF THE DRAWING

In the drawing:

FIG. 8 is an essentially complete cross-sectional view of a capacitor microphone according to the present invention;

DETAILED DESCRIPTION OF THE INVENTION

Figure 1:
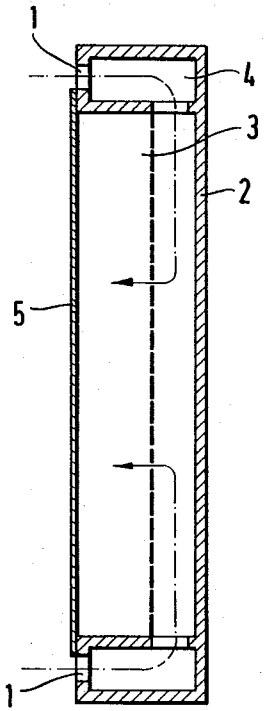
FIG. 1 is a schematic cross-sectional view of a capacitor microphone according to the invention.

A capacitor microphone according to the present invention is schematically illustrated in FIG. 1. Sound entry openings located at least approximately in the plane of the diaphragm and preferably arranged around the diaphragm edge are denoted by reference numeral 1.

Arranged within a housing 2 of the present gradient pickup are acoustically effective phase-shifting sections 3 which are in connection with the outer sound field through sound conductors 4 and are coupled to the rear side of the diaphragm. The diaphragm of this capacitive pressure gradient pickup is denoted by reference numeral 5.

Figure 2:
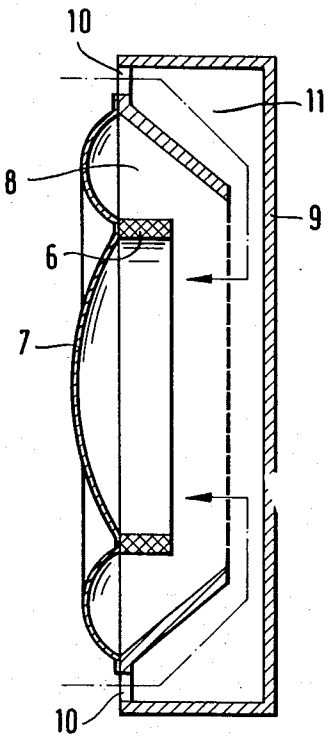
FIG. 2 is a schematic cross-sectional view of a dynamic microphone according to the invention.

FIG. 2 is a schematic representation of a dynamic microphone according to the present invention. A diaphragm 7 exposed to the outer sound field and provided with moving coil 6 is accommodated within housing 9 together with a phase-shifting section 8. Also in this case, the sound entry opening or openings 0 are located at least approximately in the plane of the diaphragm and preferably immediately adjacent the diaphragm edge. The sound is conducted from the sound entry openings 10 through sound conductors 11 to the phase-shifting sections 8 arranged in the interior of the housing 9 and the rear side of diaphragm 7.

Figure 3:
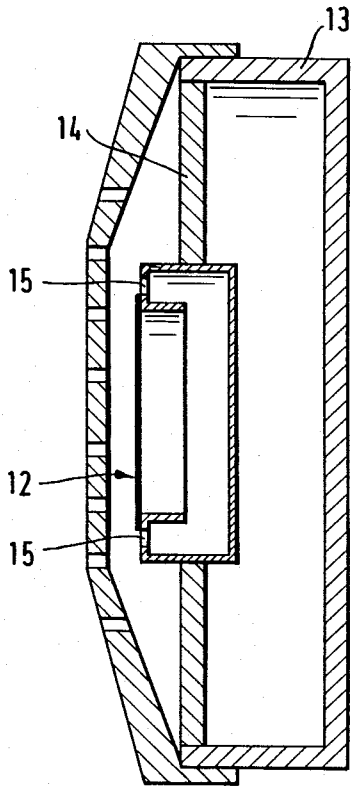
FIG. 3 is a cross-sectional view of a telephone speaker capsule according to the invention.

As can be seen from FIG. 3, a pressure gradient pickup 12 according to the invention is particularly suitable for mounting in a substantially larger, cup-shaped housing 13. In this case, the pressure gradient pickup 12 is usually mounted on a carrier plate 14, which also may be a printed board equipped with electronic components. It is essential in this embodiment that the directional effect of the microphone is obtained solely due to the arrangement of the sound entry openings 15 at least approximately in the plane of the diaphragm of the pressure gradient pickup 12. This is particularly advantageous in the case of telephone speaker capsules because a housing with fixed dimensions is used for mounting the transducer.

Figure 4:
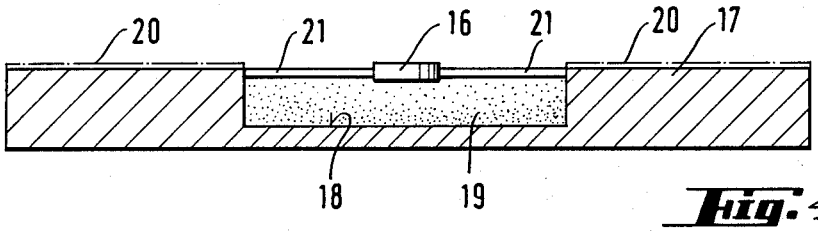
FIG. 4 is a cross-sectional view of a pressure gradient pickup according to the invention mounted in a plate.

FIG. 4 illustrates a specific possibility of using a pressure gradient pickup 16 according to the invention. Pickup 16 is mounted in a plate 17 which may be circular, rectangular, square or a regular or irregular polygon. The surface area size of the plate 17 is at least eighty times greater than that of the pressure gradient pickup. The pickup is placed in a cylindrical recess 18, such that the front of the pickup is either flush with the plate surface or projects outwardly from the plate surface by several tenths of a millimeter up to several millimeters. The pickup may be arranged in the recess 18 either centrically or excentrically. The depth of the recess 18 is about three times the height of pressure gradient pickup 16 and its diameter is about five times the diameter of the sound pickup 16. Recess 18 may be filled with a sound-absorbing material 19 which is more densely packed at the bottom of the recess than at the open side thereof. Moreover, the plate side having the recess 18 may be provided with a sound-absorbing layer 20. Thin webs 21 formed in plate 17 support the pickup 16.

Since, according to the invention, the sound entry openings of the sound pickup are located approximately in the plane of the diaphragm, a directional effect is obtained. As a result of the above-described arrangement of the pressure gradient pickup according to the invention, the use of a directional microphone has become possible in the PZM or pressure zone microphone recording technology in which in the past only a pressure pickup without any directional effect arranged in a plane plate had been used.

Figure 5:
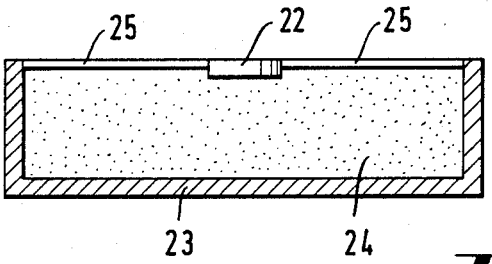
FIG. 5 is a cross-sectional view of a pressure gradient pickup according to the invention mounted in a cup-shaped member.

FIG. 5 shows the arrangement of a pressure gradient pickup 22 according to the invention in a cup-shaped housing 23. The interior of housing 23 is filled with a sound-absorbing material 24. Pressure gradient pickup 22 is supported by thin webs 25 in the opening of the cup-shaped housing 23 and is mounted in such a way that either the diaphragm plane is aligned with the plane of the opening or projects by several tenths of a millimeter to several millimeters above the plane of the opening of housing 23.

Figure 6:
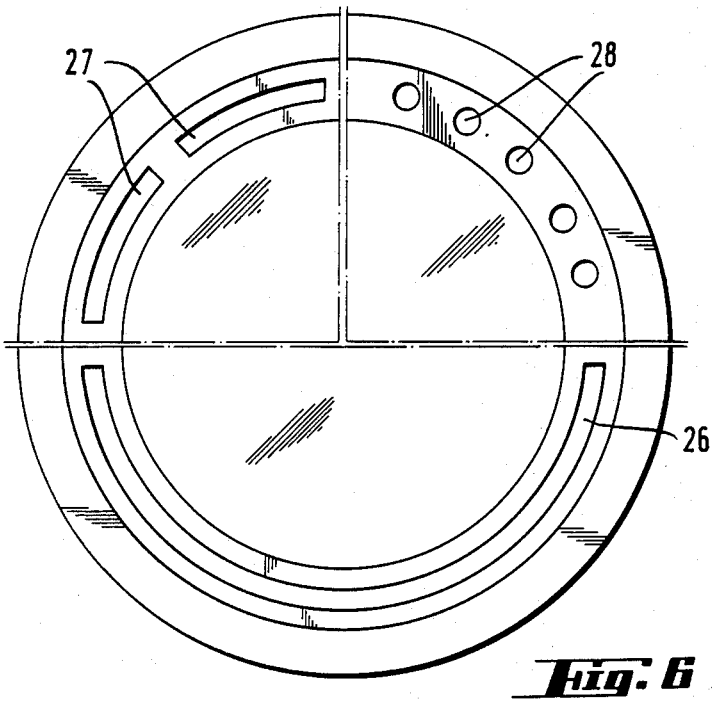
FIG. 6 is a top view of a pressure gradient pickup with sound entry openings having different shapes as provided by the present invention.
Figure 6:
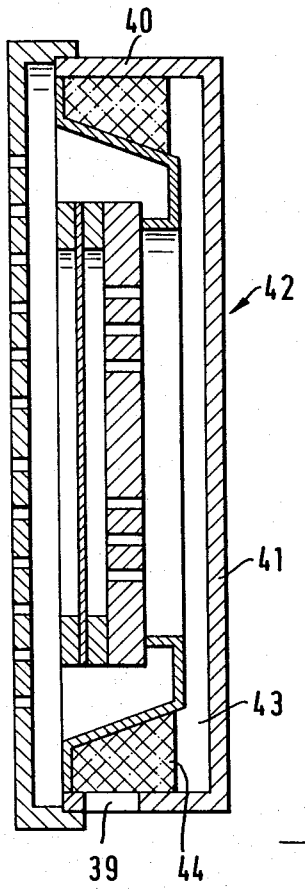

FIG. 6 is a top view of the pressure gradient pickup according to the invention. FIG. 6 shows several possibilities of providing the opening or openings which preferably are arranged around the diaphragm edge. The sound entry openings are denoted by references numerals 26, 27 and 28 and are to be understood to be examples of a complete circular arrangement.

Figure 7:
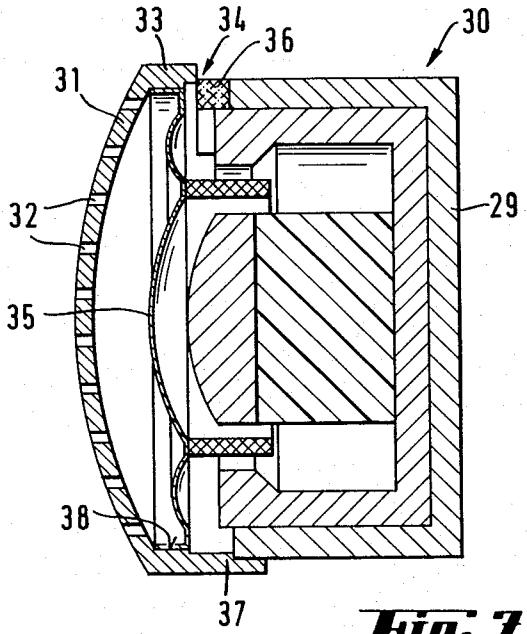
FIG. 7 is an essentially complete cross-sectional view of a dynamic microphone according to the present invention.

FIG. 7 constitutes an essentially complete cross-sectional view of a typical embodiment of a dynamic microphone. A cover 31 provided with boreholes 32 or slots 34 is placed on a housing 29 of microphone capsule 30. Slots 34 are arranged alongside the edge 33 of cover 31. These slots 34 are arranged, in accordance with the invention, at least approximately in the plane of diaphragm 35. Cover 31 is placed on housing 29 of microphone capsule 30 by means of flanges 37. Diaphragm 35 is fastened, for example, by means of thermowelding, on an annular shoulder 38 formed in cover 31. If necessary, acoustic frictional resistor 36 may be arranged immediately in slots 34 formed in cover 31.

An essentially complete cross-sectional view of an embodiment according to the invention for a capacitor microphone is illustrated in FIG. 8. Slots 39 arranged at least approximately in the diaphragm plane according to the invention are located along a rim 40 of housing 41 of microphone capsule 42. Immediately adjacent these slots 39 are located sound conductors 43 toward a phase-shifting section. An acoustic frictional resistor 44 may be arranged in sound conductors 43.

Figure 9:
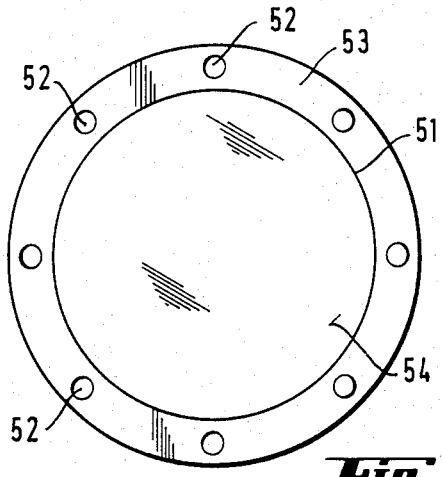
FIGS. 9 to 13 are top views of a pressure gradient pickup with openings discretely arranged in the diaphragm plane.
Figure 10:
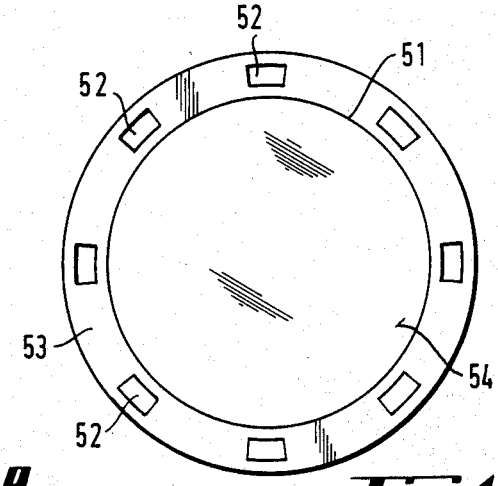
Figure 11:
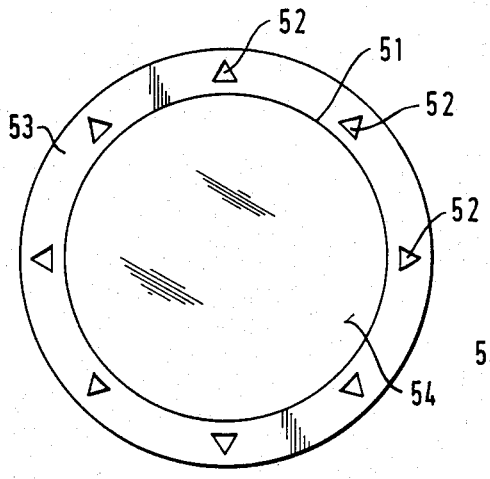
Figure 12:
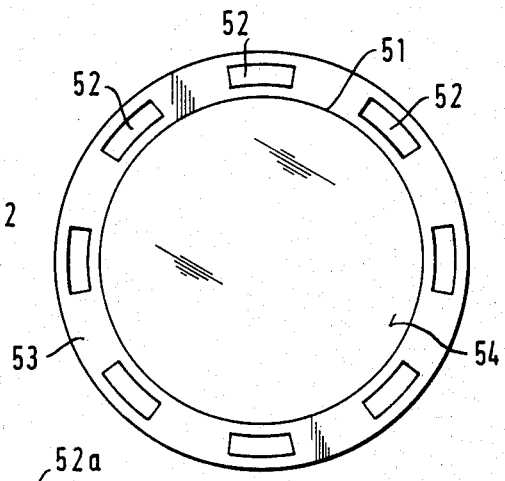
Figure 13:
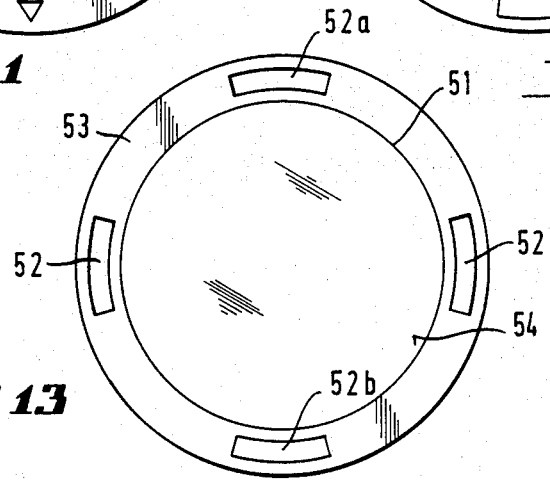

FIGS. 9–13 are top views of various possibilities of arranging sound entry openings 52 in the housing extending in the same plane as the diaphragm. Openings 52 are concentrically arranged relative to diaphragm edge 51 and may be circular, as shown in FIG. 9, trapezoidal, as shown in FIG. 10, triangular, as shown in FIG. 11, or slot-shaped, as shown in FIGS. 12 and 13. In the interior of housing 53 and behind openings 52 is arranged the phase-shifting section through which the sound reaches the rear side of transducer diaphragm 54 delayed due to the propagation time.

The openings 52 serving for the sound entry can either all be uniformly acoustically damped or they may each be provided with a different acoustic damping. Generally, two oppositely located openings will always be provided with the same damping. The damping of the openings serves to obtain the desired pickup pattern of the pressure gradient pickup and the degree of damping serves to form a cardioid, hypercardioid or supercardioid If different shapes of the pickup patterns are desired in different sectional planes extending through the transducer axis, individual sound entry openings must be acoustically damped differently than the other entry openings in accordance with the desired shape of the pattern. The simplest and most useful arrangement, which is probably the arrangement used most in actual sound recordings, is illustrated in FIG. 13 with two pairs of sound entry openings located opposite each other on diameters which extend approximately perpendicularly to each other.

Figure 16:
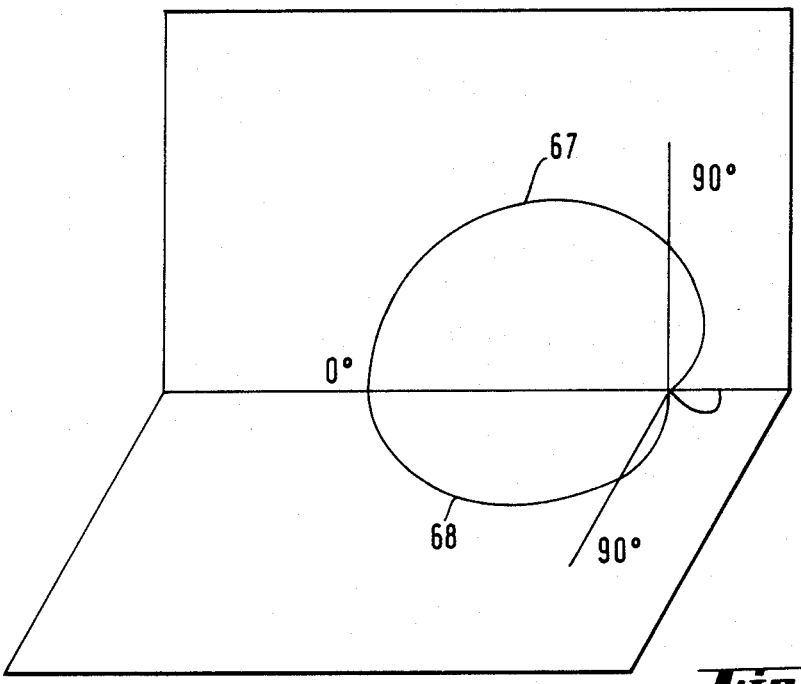
FIG. 16 is a perspective view of a spatially different pickup pattern of a pressure gradient pickup according to the invention.
Figure 17:
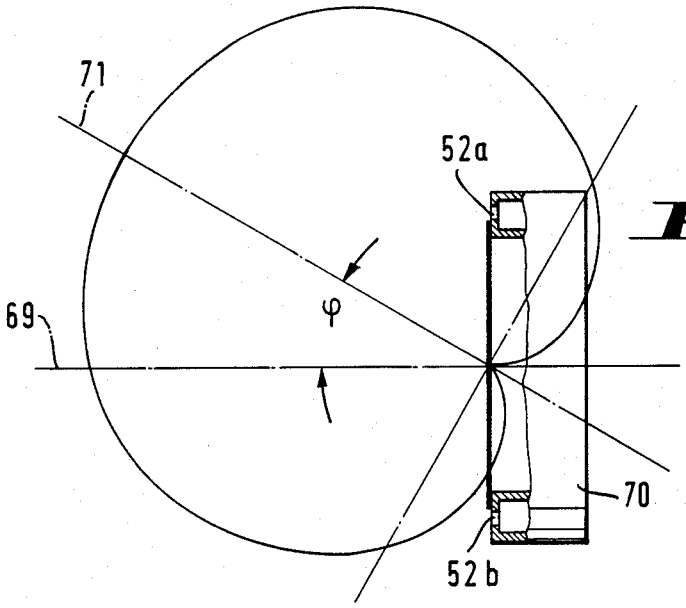
FIG. 17 is a rotationally symmetrical pickup pattern of a pressure gradient pickup according to the invention which is inclined relative to the axis of symmetry.

A pickup pattern which deviates from the shape of a rotational body as a result of the different acoustic damping of openings is illustrated in a protective view in FIG. 16 into planes extending perpendicularly to each other. For example, in the vertical plane, the adjustment can be made in such a way that the pattern in this plane corresponds to a cardioid 67, while a hypercardioid 68 is formed in the horizontal plane. However, if the upper sound entry opening **52*a* of FIG. 13, for example, is damped to a lesser degree than the two openings 52 in the middle and the lower opening 52*b*, the rotational symmetry of the pickup pattern, for example, a cardioid, is maintained, while the axis of symmetry 71 of the pickup pattern is swung by a certain angle $\phi$, as shown in FIG. 17, from the axis of symmetry 69 of the pressure gradient pickup 70 in the direction toward the sound entry opening having the least acoustic damping, i.e., opening 52*a***.

Figure 14:
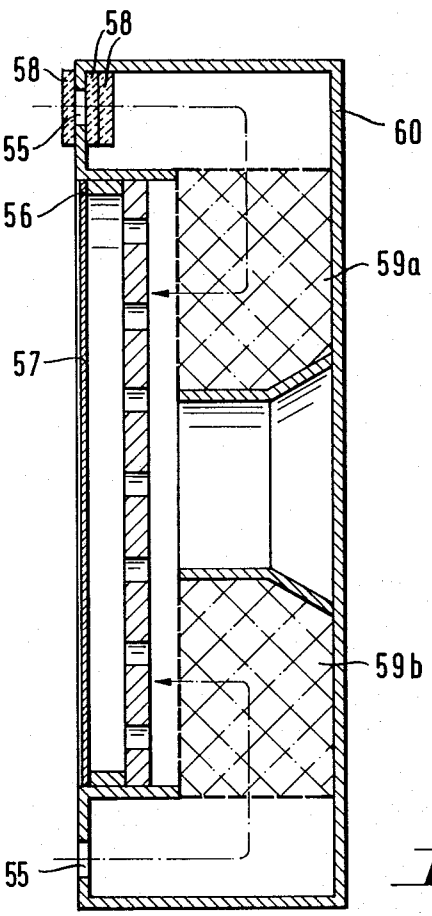
FIG. 14 is a schematic cross-sectional view of a capacitor microphone according to the invention.

FIG. 14 is a schematic cross-sectional view of a practical embodiment of a capacitor directional microphone constructed as a pressure gradient pickup according to the present invention. The openings required for sound entry are denoted by reference numeral 55 and are arranged around diaphragm edge 56 of transducer diaphragm 57. As already explained above, all of the openings 55, or only the upper sound entry openings 55, can be provided with an acoustic damping 58. Within pressure gradient housing 60 is arranged at least one phase-shifting section **59*a*, 59*b***, unless more sections are considered required.

Figure 15:
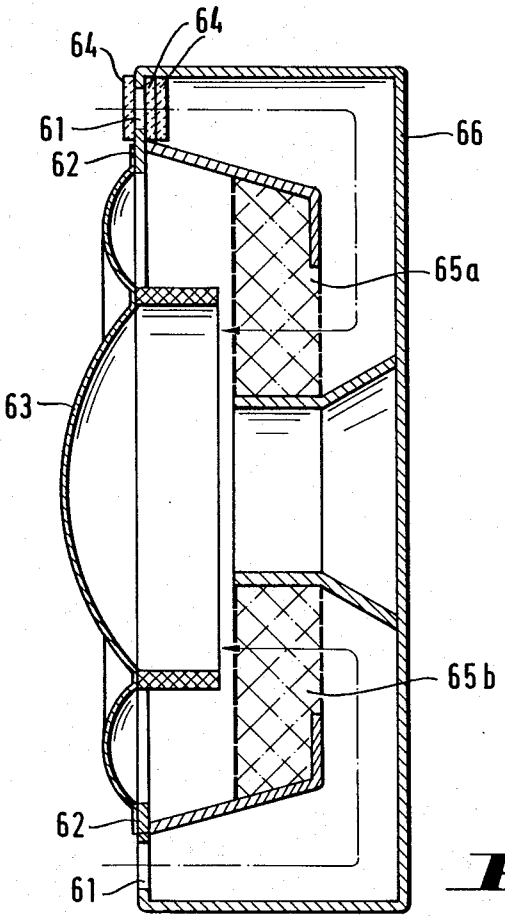
FIG. 15 is a schematic cross-sectional view of a dynamic microphone according to the invention.

FIG. 15 shows, in the same manner as FIG. 14, an embodiment of the present invention in the form of a dynamic directional microphone. The openings required for sound entry are denoted by reference numeral 61. The openings are arranged distributed around the edge 62 of a diaphragm 63 provided with a moving coil. As explained previously, an acoustic damping 64 can be provided, either immediately in the opening or next to the opening. At least one phase-shifting section **65*a* is provided in the interior of the pressure gradient pickup housing 66**.

While specific embodiments of the invention have been shown and described in detail to illustrate the application of the inventive principles, it will be understood that the invention may be embodied otherwise without departing from such principles.

We claim:

1. A pressure gradient pickup, comprising a housing, a diaphragm mounted in the housing, the housing defining at least two openings for sound entry, means for conducting the sound entering the sound entry openings to a rear side of the diaphragm, wherein phase-shifting sections which act acoustically are in connection to the sound entry openings, wherein the improvement comprises that the sound entry openings are located adjacent the diaphragm edge and at least approximately in the same plane as the diaphragm, the sound entry openings being arranged individually and spaced apart from one another, wherein at least one of the sound entry openings has an acoustical damping which is greater than that of the remaining openings.

2. The pressure gradient pickup according to claim 1, wherein the pickup is a capacitor microphone.

3. The pressure gradient pickup according to claim 1, wherein the pickup is a dynamic microphone.

4. The pressure gradient pickup according to claim 1, wherein the diaphragm defines an edge, the sound entry openings being located concentrically with the edge.

5. The pressure gradient pickup according to claim 1, wherein the sound entry openings are annular slots.

6. The pressure gradient pickup according to claim 5, wherein the sound entry openings are arranged as annular segments around the diaphragm edge.

7. The pressure gradient pickup according to claim 4, wherein the sound entry openings are a plurality of openings.

8. The pressure gradient pickup according to claim 7, wherein the openings are circular.

9. The pressure gradient pickup according to claim 1, wherein several openings have an acoustic damping which is greater than that of the other openings.

10. The pressure gradient pickup according to claim 1, wherein four sound entry openings are provided, the openings being arranged in diametrically oppositely located pairs, wherein each pair is located on a common axis of symmetry and the two axes of symmetry extend essentially perpendicularly to each other, and wherein each pair of oppositely located openings is damped equally.

11. The pressure gradient pickup according to claim 1, wherein two oppositely located sound entry openings are provided one of which is acoustically damped to a greater extent than the other opening.

* * * * *